US010898783B1

(12) United States Patent
Snowder

(10) Patent No.: US 10,898,783 B1
(45) Date of Patent: Jan. 26, 2021

(54) COLLAPSIBLE SPORTS CAGE

(71) Applicant: Charlie Snowder, Escondido, CA (US)

(72) Inventor: Charlie Snowder, Escondido, CA (US)

( * ) Notice: Subject to any disclaimer, the term of this patent is extended or adjusted under 35 U.S.C. 154(b) by 0 days.

(21) Appl. No.: 16/736,708

(22) Filed: Jan. 7, 2020

(51) Int. Cl.
*A63B 71/00* (2006.01)
*A63B 71/02* (2006.01)
*A63B 67/00* (2006.01)

(52) U.S. Cl.
CPC ..... *A63B 71/022* (2013.01); *A63B 2210/56* (2013.01)

(58) Field of Classification Search
CPC ..... A63B 71/022; A63B 2210/56
USPC ..... 473/421, 422, 197
See application file for complete search history.

(56) References Cited

U.S. PATENT DOCUMENTS 849,941 A * 4/1907 Titus ..... A63B 71/022 473/421
3,408,071 A * 10/1968 Lundy ..... A63B 71/022 473/421
3,475,025 A * 10/1969 Uphaus ..... A63B 71/022 473/421
5,169,157 A * 12/1992 Salmon ..... F41J 1/10 273/407
5,178,384 A * 1/1993 Gorman ..... A63B 71/022 473/451
5,672,125 A * 9/1997 Ross ..... A63B 71/022 473/421
6,758,770 B2 * 7/2004 Chandronnait ..... A63B 61/003 473/492
9,795,849 B2 * 10/2017 Nelson ..... A63B 69/0002 473/446
10,080,948 B2 * 9/2018 Manieri ..... A63B 71/022 473/446
10,124,233 B2 * 11/2018 Nelson ..... A63B 69/00 473/446
10,183,206 B2 * 1/2019 Nelson ..... A63B 71/022 473/446
10,195,508 B2 * 2/2019 Rigoli ..... A63B 69/0024 473/433

(Continued)

*Primary Examiner* — Mitra Aryanpour
(74) *Attorney, Agent, or Firm* — John R. Ross, III; John R. Ross

(57) ABSTRACT

A collapsible sports cage system. The system includes a wench that has a retractable cable. A collapsible sports cage is connected to the retractable cable. The collapsible sports cage is capable of moving from an in-use upright position to a non-use lowered position. The collapsible sports cage has pivot feet and pivotally connected support posts that are pivotally connected to the pivot feet. Lower position support braces are rigidly connected to the pivotally connected support posts. When the collapsible sports cage is in a non-use lowered position the lower position support braces are braced against the ground. Pivotally connected upper support beams are pivotally connected between the pivotally connected support posts. Also, horizontal overhead support beams are rigidly connected between the pivotally connected support posts. A ball retention net is draped over the collapsible sports cage. When the wench pulls the collapsible sports cage from the non-use lowered position to the in-use upright position, the collapsible sports cage is ready for usage. Likewise, the user may place the sports cage in a non-use position by using the wench to lower the collapsible sports cage from an in-use upright position to a non-use lowered position.

3 Claims, 4 Drawing Sheets

(56) References Cited

U.S. PATENT DOCUMENTS

| | | | | |
|---|---|---|---|---|
| 10,226,679 | B2 * | 3/2019 | Nelson | A63B 63/00 473/446 |
| 10,537,779 | B2 * | 1/2020 | Nelson | A63B 69/00 473/446 |
| 10,543,413 | B2 * | 1/2020 | Nelson | A63B 61/00 473/446 |
| 2009/0286631 | A1 * | 11/2009 | Hammons | A63B 71/022 473/455 |
| 2015/0031480 | A1 * | 1/2015 | Kidd, III | A63B 63/00 473/478 |

* cited by examiner

COLLAPSIBLE SPORTS CAGE

The present invention relates to sports gear, and in particular, to sports cages.

BACKGROUND OF THE INVENTION

Sports cages are known in the prior art. With utilization of a retention net, a sports cage allows for the athlete to practice his sport without having to worry about chasing down far-hit balls. An example of a popular sports cage is the batting cage. A batting cage allows a batter (in baseball or softball) to practice hitting the ball. The retention net is generally draped over the cage and stops the ball as it is hit and prevents the ball from going far away.

For this reason, sports cages with a retention net are an exemplary tool for practice. Unfortunately, however, sports cages are difficult to find for most people. To utilize a sports cage a customer usually must travel to a business, pay a fee, and use the cage for a relatively short period of time.

It is unusual for an individual or a family to own their own sports cage. One major reason is that sports cages are very large and very tall. They can create an eyesore for a neighborhood or community. Homeowners associations and community standards often dictate rules that would prevent the private home ownership of a large, tall sports cage. Therefore, private ownership of a sports cage is very rare.

What is needed is a better sports cage that allows for acceptable private usage and ownership.

SUMMARY OF THE INVENTION

The present invention provides a collapsible sports cage system. The system includes a wench that has a retractable cable. A collapsible sports cage is connected to the retractable cable. The collapsible sports cage is capable of moving from an in-use upright position to a non-use lowered position. The collapsible sports cage has pivot feet and pivotally connected support posts that are pivotally connected to the pivot feet. Lower position support braces are rigidly connected to the pivotally connected support posts. When the collapsible sports cage is in a non-use lowered position the lower position support braces are braced against the ground. Pivotally connected upper support beams are pivotally connected between the pivotally connected support posts. Also, horizontal overhead support beams are rigidly connected between the pivotally connected support posts. A ball retention net is draped over the collapsible sports cage. When the wench pulls the collapsible sports cage from the non-use lowered position to the in-use upright position, the collapsible sports cage is ready for usage. Likewise, the user may place the sports cage in a non-use position by using the wench to lower the collapsible sports cage from an in-use upright position to a non-use lowered position.

DETAILED DESCRIPTION OF THE PREFERRED EMBODIMENTS

Figure 5:
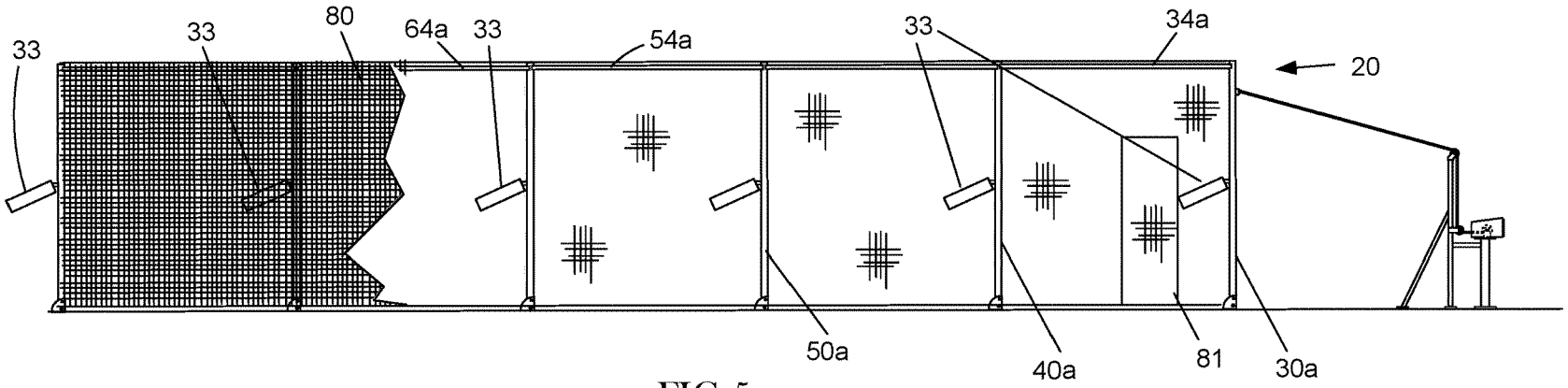
FIGS. 5-7 show the utilization of a preferred embodiment of the present invention
Figure 7:
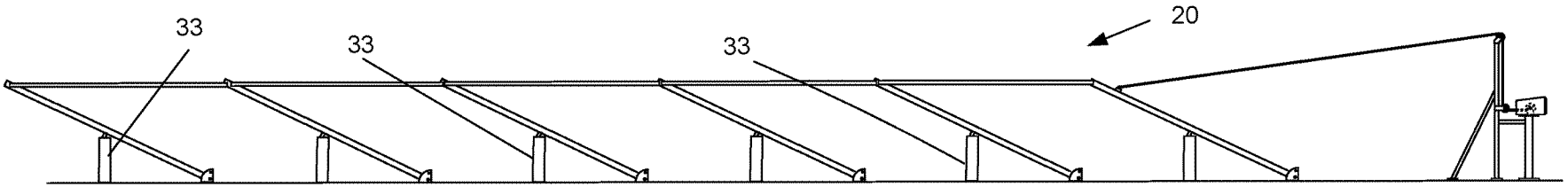

The present invention allows for a user of collapsible sports cage 20 (FIG. 1, FIG. 5) to utilize the cage for his enjoyment, and then easily lower the cage when finished. When lowered in height, cage 20 is less likely to be visible and less likely to offend neighbors or break neighborhood rules. For example, FIG. 5 shows collapsible cage 20 in an upright position ready for usage. In the preferred embodiment shown the dimensions of collapsible cage 20 are 10-foot-high×10-foot-wide×50-foot-long. In FIG. 7, collapsible cage 20 has been fully lowered to a lowered, non-use position. Its height is now only approximately 4-foot, two-inches, a much more manageable and less obtrusive height. Lower position support braces 33 keep collapsible cage 20 slightly elevated to prevent damage to cage 20 and its components.

Wench System

Figure 1:
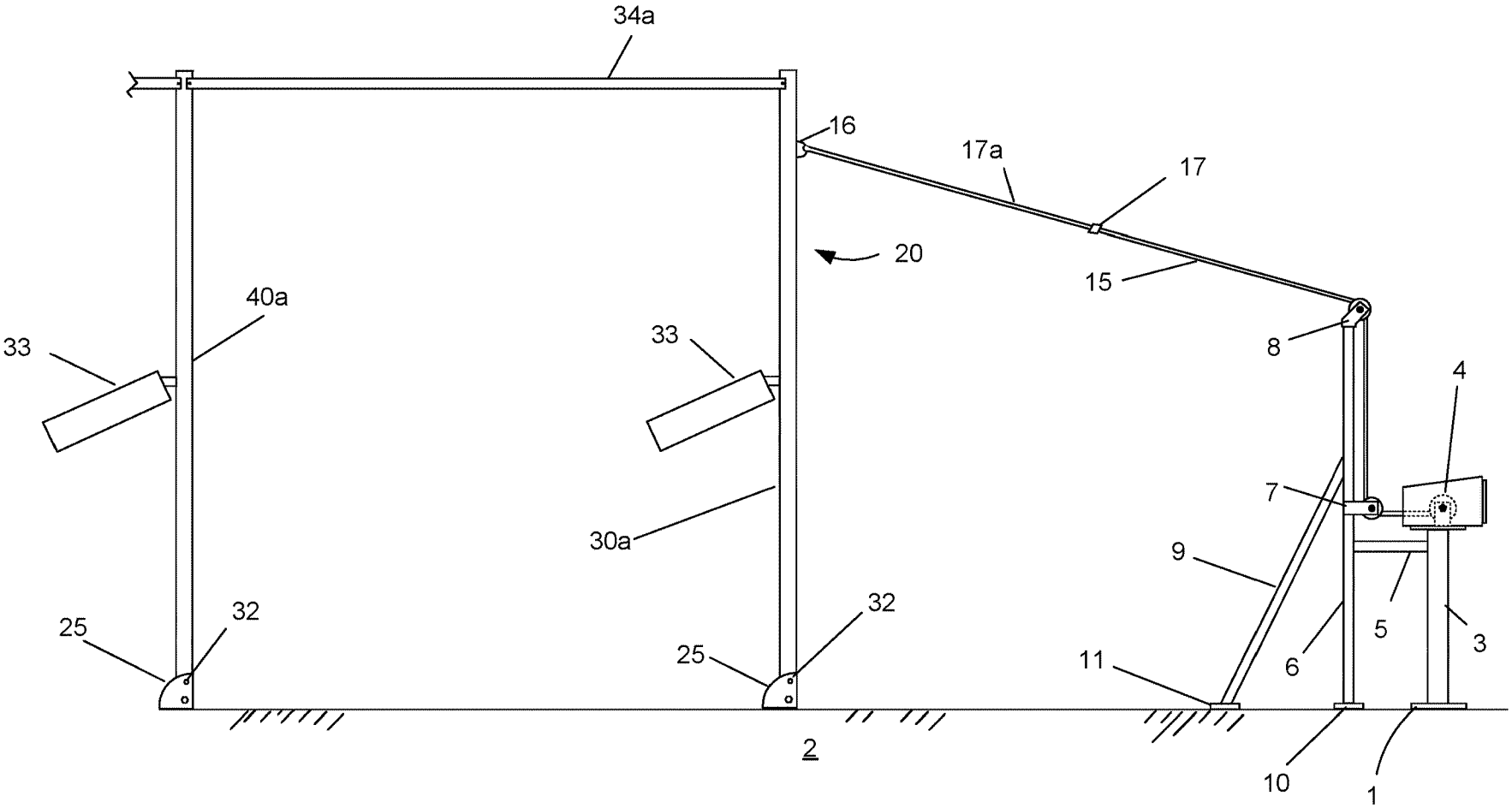
FIG. 1 shows a side view of a preferred embodiment of the present invention.

FIG. 1 shows a preferred embodiment of the present invention. Support plate 1 is bolted to ground 2. Support post 3 is rigidly connected to support plate 1. Remote controlled electrical wench 4 is rigidly connected to post 3. Horizontal support post 5 is rigidly connected to post 3 and support post 6. Support post 6 is rigidly connected to support plate 10. Support plate 10 is bolted to ground 2. Lower pully 7 and upper pully 8 are both connected to post 6, as shown. Support post 9 is rigidly connected to post 6 and to support plate 11. Support plate 11 is bolted to ground 2. Flexible cable 15 has been routed through pullies 7 and 8 as shown. Cable 15 is wound around wench 4 at a first end and is connected to "Y" mechanism 17 at its other end. "Y" mechanism allows for cable 17*a* to connect to hook 16 of post 30*a* and cable 17*b* to connect to post 30*b* (see also FIG. 4).

Collapsible Sports Cage

Figure 3:
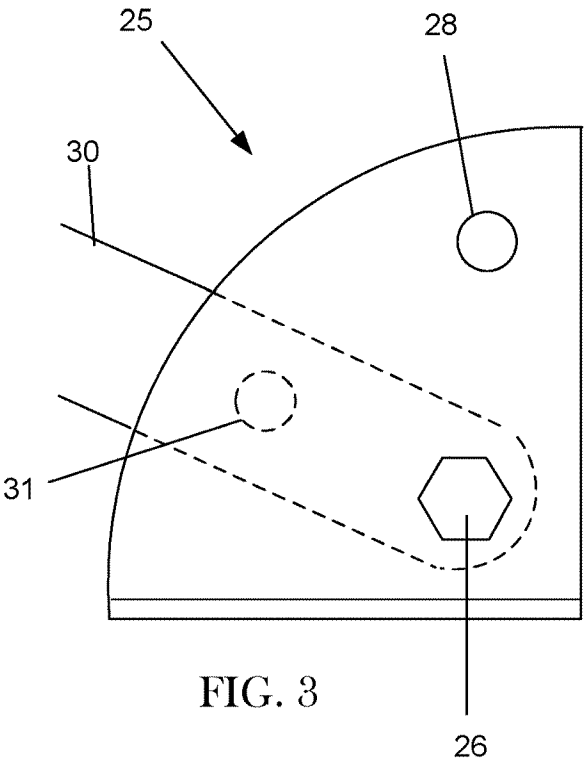
FIGS. 2-3 show a preferred pivot foot.
Figure 2:
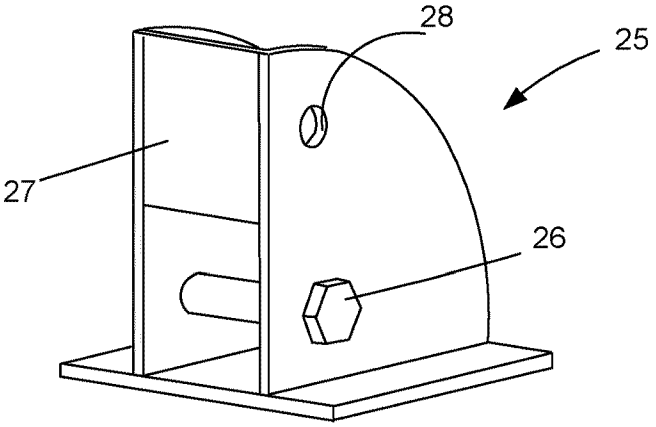

Pivot foot 25 is bolted to ground 2. FIGS. 2 and 3 show details of a preferred pivot foot 25. Pivot foot 25 includes pivot axis 26, back brace 27 and locking pin hole 28. As shown in FIG. 3, post 30*a* is pivotally attached to pivot foot 25 at pivot axis 26. Post 30*a* includes locking pin hole 31, that corresponds to locking pin hole 28 of pivot foot 25. For example, when post 30*a* has been pivoted to a vertical position, a locking pin may be inserted into pin holes 28 and 31 to hold post 30*a* vertical.

Figure 4:
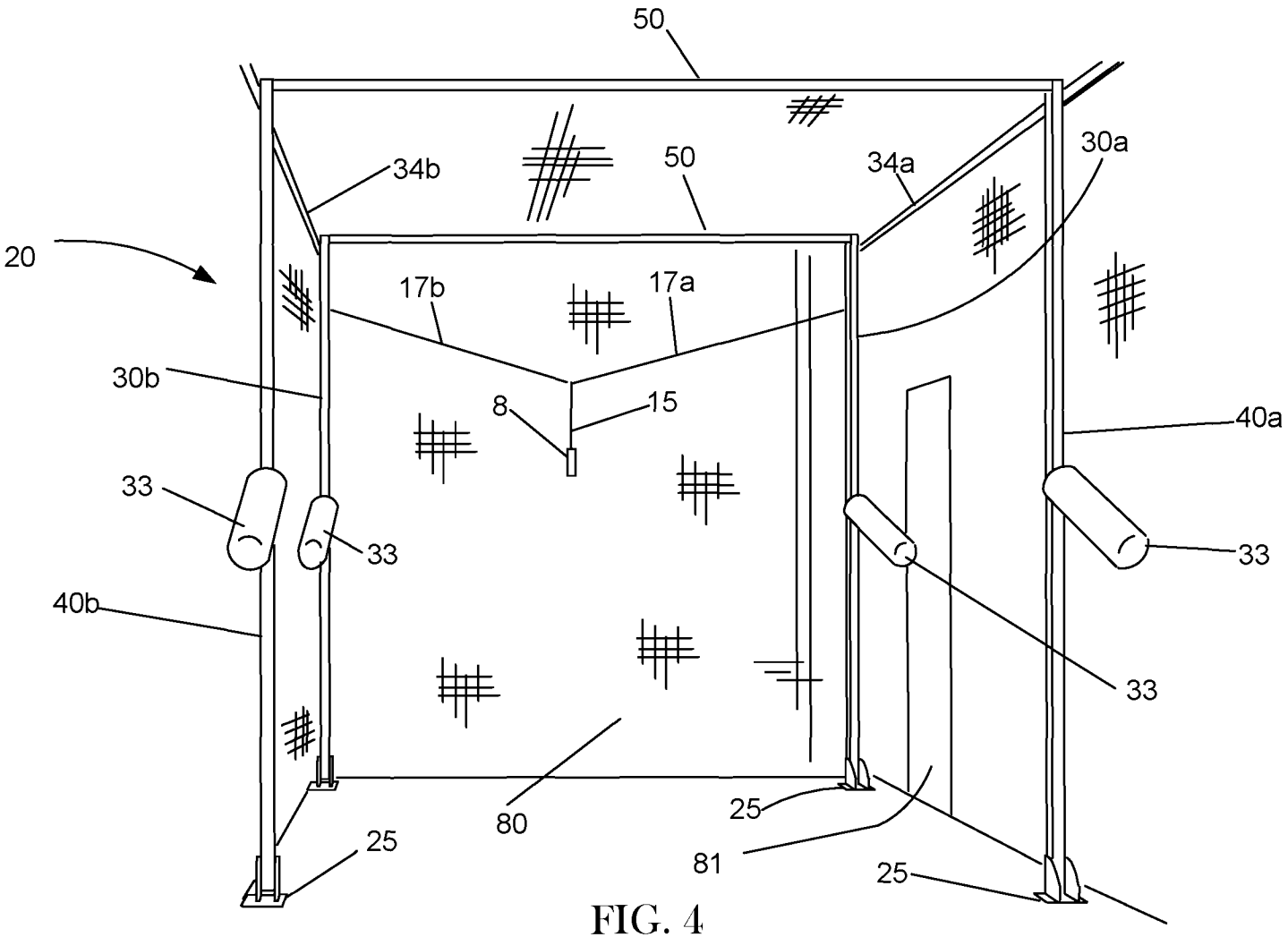
FIG. 4 shows a perspective interior view of a preferred embodiment of the present invention.

FIG. 1 shows a side view and FIG. 4 shows a perspective view of collapsible sports cage 20. When referring to the side view shown in FIG. 1 (and later FIGS. 5-7) it should be appreciated only one side of sports cage 20 is being shown and that matching structure and components are also included on the other side. For example, refer to the perspective presentation shown in FIG. 4.

In FIGS. 1 and 4, post 30*a* is pivotally connected to pivot foot 25 and is in a vertical position. Locking pin 32 has been inserted through locking holes 28 and 31 to assist holding post 30 vertically. Lower position support brace 33 is rigidly connected to post 30 as shown. Upper support beam 34*a* is pivotally connected to post 30*a* at one end and pivotally connected to post 40*a* at its other end. Hook 16 is connected to post 30*a*. Horizontal overhead support beams 50 are rigidly connected between adjacent pivotally connected posts and provide structural support to the pivotally connected posts. For example, as shown in FIG. 4, rigidly connected support beam 50 provides support between posts 30*a* and 30*b* and rigidly connected support beam 50 provides support between posts 40*a* and 40*b*.

FIG. 5 shows collapsible cage 20 in its upright position. Ball retention net 80 has been draped over collapsible cage

20 and functions to retain a sports ball within the confines of collapsible cage 20. Net 80 preferably includes access door 81, as shown (see also FIG. 4). In FIG. 5, wench 4 has been fully wound in causing cable 15 to pull posts 30*a*-80*b* to rotate them clockwise so that they are braced against back brace 27 (FIG. 2). Locking pins 32 have been inserted into locking holes 28 and 31 for safety and to hold collapsible cage 20 secure in the upright position shown. In FIG. 5, collapsible cage 20 is ready for usage.

Placing the Collapsible Cage into a Lowered, Non-Use Position

Figure 6:
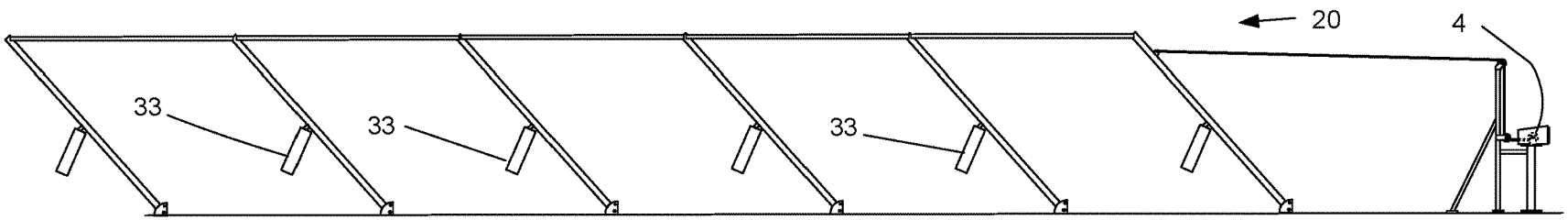

FIGS. 6-7 show a preferred method for placing collapsible cage 20 into a lowered, non-use position. Although FIGS. 6-7 do not show net 80 for drawing clarity, it should be understood that net 80 preferably remains draped over collapsible cage 20 as it is being lowered into a non-use position.

In FIG. 6, the user has removed locking pins 32 from locking pin holes 28 and 31. The user has then unwound wench 4, thereby permitting gravity to rotate posts 30*a*-80*b* counterclockwise about pivot axis 26 of pivot foot 25. In FIG. 6, lower position support braces 33 are approaching contact with the ground.

In FIG. 7, the user has further unwound wench 4 until lower position support braces 33 have each contacted the ground, thereby halting further counterclockwise rotation. Collapsible cage 20 is now fully lowered and is secure until needed again.

To use collapsible cage 20 again, the user will utilize wench 4 to wind cable in 15, thereby pulling on collapsible cage 20. Posts 30*a*-80*b* will each pivot clockwise until stopped by back brace 27. Locking pins 32 are then inserted into locking holes 31 and 28 to hold each post 30*a*-80*b* vertical.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A collapsible sports cage system, comprising:

a wench, comprising a retractable cable, and a collapsible sports cage connected to said retractable cable, said collapsible sports cage capable of moving from an in-use upright position to a non-use lowered position, said collapsible sports cage comprising:

a. a plurality of pivot feet, b. a plurality of pivotable support posts, each one of said pivotable support posts pivotally connected to one pivot foot of said plurality of pivot feet, c. a plurality of lower position support braces, each one of said plurality of lower position support braces rigidly connected to one of said pivotable support posts, wherein said collapsible sports cage is in said non-use lowered position when said plurality of lower position support braces are braced against the ground, d. a plurality of pivotally connected upper support beams, each one of said plurality of pivotally connected upper support beams pivotally connected between two of said plurality of pivotable support posts, e. a plurality of horizontal overhead support beams, each one of said horizontal overhead support beams rigidly connected between two of said plurality of pivotable support posts, and f. a ball retention net draped over said collapsible sports cage, wherein said wench pulls said collapsible sports cage from said non-use lowered position to said in-use upright position when said collapsible sports cage is ready for usage, and wherein said wench lowers said collapsible sports cage from said in-use upright position to said non-use lowered position when said sports cage is not in use.

2. The collapsible sports cage system as in claim 1, wherein said wench is an electrical wench.

3. The collapsible sports cage system as in claim 1, wherein said ball retention net comprises and access door.

* * * * *